US011382815B2

(12) United States Patent
Ravari et al.

(10) Patent No.: US 11,382,815 B2
(45) Date of Patent: Jul. 12, 2022

(54) PATIENT TRANSPORT DEVICE AND METHOD

(71) Applicants: Shahram Ravari, Irvine, CA (US); Jamshid Jamshidi, Irvine, CA (US); Shahram Gharibshahi, Sherman Oaks, CA (US)

(72) Inventors: Shahram Ravari, Irvine, CA (US); Jamshid Jamshidi, Irvine, CA (US); Shahram Gharibshahi, Sherman Oaks, CA (US)

( * ) Notice: Subject to any disclaimer, the term of this patent is extended or adjusted under 35 U.S.C. 154(b) by 0 days.

(21) Appl. No.: 16/543,278

(22) Filed: Aug. 16, 2019

(65) Prior Publication Data

US 2021/0045952 A1 Feb. 18, 2021

(51) Int. Cl.
*A61G 7/10* (2006.01)

(52) U.S. Cl.
CPC ..... *A61G 7/1046* (2013.01); *A61G 7/1015* (2013.01); *A61G 7/1017* (2013.01); *A61G 7/1051* (2013.01); *A61G 7/1063* (2013.01); *A61G 7/10* (2013.01); *A61G 7/1019* (2013.01); *A61G 7/1023* (2013.01)

(58) Field of Classification Search
CPC .. A61G 7/1046; A61G 7/1015; A61G 7/1017; A61G 7/1051; A61G 7/1063; A61G 7/1038; A61G 7/1019; A61G 7/1023; A61G 7/1044; A61G 7/1049; A61G 7/1057; A61G 7/1055; A61G 7/10
See application file for complete search history.

(56) References Cited

U.S. PATENT DOCUMENTS 2,666,212 A * 1/1954 Flanders ..... A61G 7/1015 5/86.1
2,962,730 A * 12/1960 Carnes ..... A61G 7/053 5/86.1
3,123,224 A * 3/1964 Kral ..... A61G 7/1019 212/330
3,829,916 A * 8/1974 James ..... A61G 7/1019 5/83.1
3,999,228 A * 12/1976 Thomas ..... A61G 7/1015 5/83.1
4,141,094 A * 2/1979 Ferguson ..... A61G 5/14 280/250.1

(Continued)

*Primary Examiner* — Peter M. Cuomo
*Assistant Examiner* — Morgan J McClure
(74) *Attorney, Agent, or Firm* — Arman Khosraviani

(57) ABSTRACT

A wheelchair for transporting a patient comprising a support frame, the support frame having an upper portion located substantially near a first end of the support frame and a lower portion located substantially near a second end of the support frame, at least one seat extension, the seat extension moveably coupled to the support frame between the lower portion and upper portion of the support frame, at least one leg, a first leg coupled to the lower portion of the support frame, at least two wheels mounted on the support frame, an anti-tip bar, the anti-tip bar being substantially horizontally disposed on the lower portion of the support frame and projecting in the lateral direction for stabilizing the wheelchair in the lateral direction, and an extendable beam positioned on the upper portion of the support frame and moveable coupled to the support frame.

24 Claims, 6 Drawing Sheets

(56) References Cited

U.S. PATENT DOCUMENTS 4,226,413 A * 10/1980 Daugherty ..... A61H 3/04 188/1.12
4,703,523 A * 11/1987 James ..... A61G 7/1017 5/83.1
4,704,749 A * 11/1987 Aubert ..... A61G 7/1019 280/250.1
4,981,307 A * 1/1991 Walsh ..... A61G 5/10 2/311
5,333,333 A * 8/1994 Mah ..... A61G 5/10 280/250.1
5,388,289 A * 2/1995 Casperson ..... A61G 5/00 280/250.1
5,451,193 A * 9/1995 Pickard ..... A61G 5/00 280/250.1
5,561,872 A * 10/1996 Phillips ..... A61G 7/1007 4/254
5,569,129 A * 10/1996 Seif-Naraghi ..... A61G 7/1019 135/67
5,676,388 A * 10/1997 Bertani ..... A61H 3/04 280/250.1
5,702,326 A * 12/1997 Renteria ..... A61H 3/04 135/67
5,758,371 A * 6/1998 VanDyke ..... A61G 7/1015 5/86.1
5,819,338 A * 10/1998 Hession ..... A61G 5/104 5/86.1
6,430,761 B1 * 8/2002 Brandorff ..... A61G 7/053 5/81.1 R
8,876,149 B2 * 11/2014 Wilson ..... A61G 5/1002 280/657
2003/0137119 A1 * 7/2003 Razon ..... A61H 3/008 280/87.021
2003/0141691 A1 * 7/2003 Perena ..... A61G 5/14 280/250.1
2004/0212173 A1 * 10/2004 Wing ..... A61G 5/006 280/304.1
2008/0028516 A1 * 2/2008 Morishima ..... A61G 7/1051 5/89.1
2010/0287698 A1 * 11/2010 Stryker ..... A61G 5/1059 5/87.1
2012/0240332 A1 * 9/2012 Palay ..... A61G 7/1023 5/83.1
2013/0168945 A1 * 7/2013 Pivato ..... A61G 7/1046 280/304.1
2015/0035333 A1 * 2/2015 Schy ..... A61G 7/1011 297/331
2017/0056267 A1 * 3/2017 Stryker ..... A61N 1/36003
2017/0066462 A1 * 3/2017 Wright ..... A61G 7/1019
2018/0214329 A1 * 8/2018 Mitchell ..... A61G 7/1073
2019/0008710 A1 * 1/2019 Wilson ..... A61G 7/1046
2019/0053970 A1 * 2/2019 Vatti ..... A61H 3/008
2019/0076310 A1 * 3/2019 Poulos ..... A61G 7/053

* cited by examiner

PATIENT TRANSPORT DEVICE AND METHOD

FIELD

The present disclosure generally relates to wheelchairs and, more particularly, a portable patient transport system configured to transport impaired, non-ambulatory, or physically challenged patients into and out of a wheelchair.

BACKGROUND

Individuals who are non-ambulatory, impaired, or physically challenged patients require a wheelchair for mobility. Transporting patients using conventional wheelchairs can be inconvenient and uncomfortable for patients. Some patients need substantial assistance to be placed into and out of a bed or vehicle, requiring significant muscular strength or at least two caregivers to lift the patient and place them in seated or lying position. Depending on the head room, ride height, and seating of the vehicle, adjusting the wheelchair or positioning the vehicle to accommodate comfortable transport of a patient can be difficult and very time consuming. Over the years many patient transfer devices have been developed to aid in transferring non-ambulatory patients from conventional wheelchairs. For example, harnesses, belts, slide sheets, and slings allow a caregiver to secure the patient and obtain leverage for lifting, pivoting, and moving patients onto or from a wheelchair.

To provide easier transport of patients, manual and hydraulic lift systems were developed to raise and suspend a patient in air for transport. The patient is secured in a slide sheet, sling, or harness and raised using one or more pulleys to a predetermined height above the wheelchair. Once the patient is suspended at a predetermined height, the lift system can be rolled towards a bed or vehicle then lowered to transport the patient. Of particular note, is the Hoyer hydraulic lift system. In a Hoyer lift system, a pad fits under the patient's body and connects with straps or chains to the lift frame. A hydraulic pump is used to lift the patient off the bed or seat surface. Once the patient is suspended in the air, the Hoyer lift can be maneuvered to a wheelchair or another surface by pushing the lift on its wheels. A wheel mechanism is slowly turned to lower the person into a seated or lying position. The pad will stay under the person, but the chains or straps are disconnected. While the Hoyer hydraulic lift system makes patient transport easier, it requires significant space to maneuver in a home, hospital, or near a vehicle. Moreover, the size of the lift frame together with the pad and straps inhibit caregivers from transferring patients into a small space such as a vehicle cabin to be lowered onto the seat. Thus, there exists a need in the art for a portable patient transport system to enable caregivers to readily and easily transport patients.

SUMMARY

The disclosed subject matter relates to a wheelchair for transporting a patient comprising a support frame, the support frame having an upper portion located substantially near a first end of the support frame and a lower portion located substantially near a second end of the support frame, at least one seat extension, the seat extension moveably coupled to the support frame between the lower portion and upper portion of the support frame, at least one leg, a first leg coupled to the lower portion of the support frame, at least two wheels mounted on the support frame, an anti-tip bar, the anti-tip bar being substantially horizontally disposed on the lower portion of the support frame and projecting in the lateral direction for stabilizing the wheelchair in the lateral direction, and an extendable beam positioned on the upper portion of the support frame and moveable coupled to the support frame.

It is understood that other configurations of the present disclosure will become readily apparent to those skilled in the art from the following detailed description, wherein various configurations of the present disclosure are shown and described by way of illustration. As will be realized, the present disclosure of other different configurations and its several details are capable of modifications in various other respects, all without departing from the subject technology. Accordingly, the drawings and the detailed description are to be regarded as illustrative in nature and not restrictive.

BRIEF DESCRIPTION OF THE DRAWINGS

Certain features of the present disclosure are set forth in the appended claims. However, for purpose of explanation, several implementations of the present disclosure are set forth in the following figures.

Figure 1A:
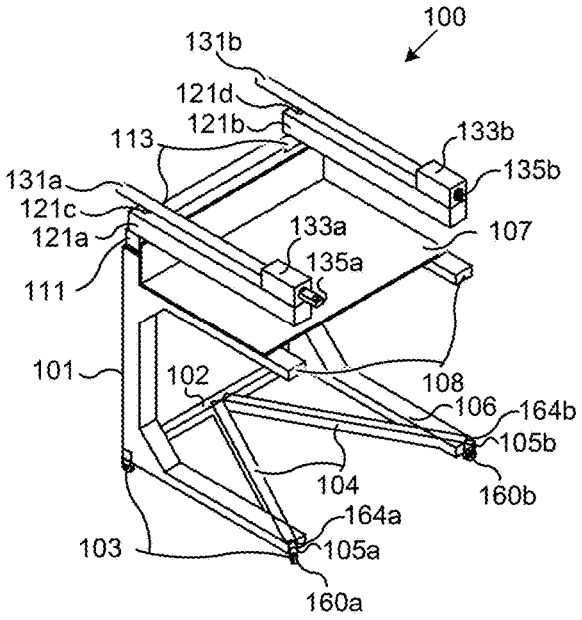
FIGS. 1A-1D illustrate side and perspective views of an exemplary embodiment of a patient transport device in accordance with one or more exemplary embodiments of the present disclosure in accordance with one or more exemplary embodiments of the present disclosure.

Embodiments of the present disclosure and their advantages are best understood by referring to the detailed description that follows. It should be appreciated that like-reference-numerals are used to identify like-elements illustrated in one or more of the figures.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts have been exaggerated to better illustrate details and features of the present disclosure.

Various features of the present disclosure will now be described and is not intended to be limited to the embodiments shown herein. Modifications to these features and embodiments will be readily apparent to those skilled in the art, and the principles defined herein may be applied to other embodiments without departing from the scope of the disclosure.

In the following detailed description, numerous specific details are set forth by way of examples in order to provide a thorough understanding of the relevant teachings. However, it should be apparent that the present teachings may be practiced without such details. In Other instances, well known methods, procedures, components, and/or circuitry have been described at a relatively high-level, without detail, in order to avoid unnecessarily obscuring aspects of the present teachings.

FIGS. 1A-1D illustrate an exemplary transport device 100 in accordance with one or more exemplary embodiments of the present disclosure. As shown in FIG. 1A, lower portion of the exemplary transport device 100 may include a support frame 101, support brace 102, at least two wheels 103 attached to the support frame 101, anti-tip support frames 104, anti-tip bars 105*a*, 105*b* (hereafter "anti-tip bars 105"), wheel locks 160*a*, 160*b*, legs 106, and at least two seat extensions 108.

To the support frame 101 may be attached a sheet 107. The sheet 107 may extend laterally along the support frame 101 to provide back support for a patient 180. The sheet 107 may extend outwardly from support frame 101 and along seat extensions 108 to provide seating support for a patient. The sheet 107 may be composed of a single fabric or multiple fabrics. The sheet 107 may comprise of one piece, or a plurality of interconnecting pieces to independently provide the desired seating support and back support, for example, a seat cushion and padded back rest.

The seat extensions 108 may be retractable, foldable, telescopic, or otherwise collapsible to allow the transport device 100 to be folded or collapsed into a portable size. The seat extensions 108, support frame 101, support brace 102, anti-tip support frames 104, anti-tip bars 105, and legs 106 may be solid, hollow, substantially solid, or substantially hollow and composed of any suitable material, for example metals, plastics, reinforced materials, composites, and the like to ensure safe transport of human body weight.

The seat extensions 108 together with sheet 107 may be selectively configured for transferring a patient into and out of the transport device 100 by folding or collapsing towards the support frame 101 to enable a caregiver to raise or move the patient away from the transport device 100. Moreover, the seat extensions 108 and sheet 107 may include a detachable seat back, head rest, and cushioning to enable an upright and comfortable seating position for patient 180.

Figure 2A:
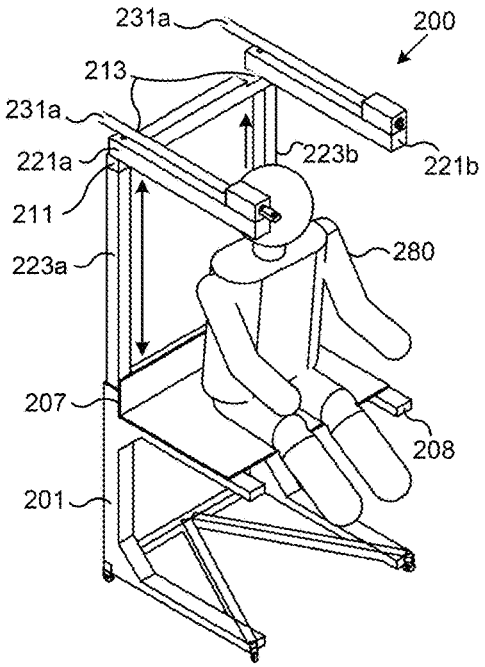
FIGS. 2A-2D illustrate side, plan, and perspective views of an exemplary embodiment of the patient transport device of FIGS. 1A-1D with moveable booms and masts positioned to support a patient transport in accordance with one or more exemplary embodiments of the present disclosure.
Figure 2B:
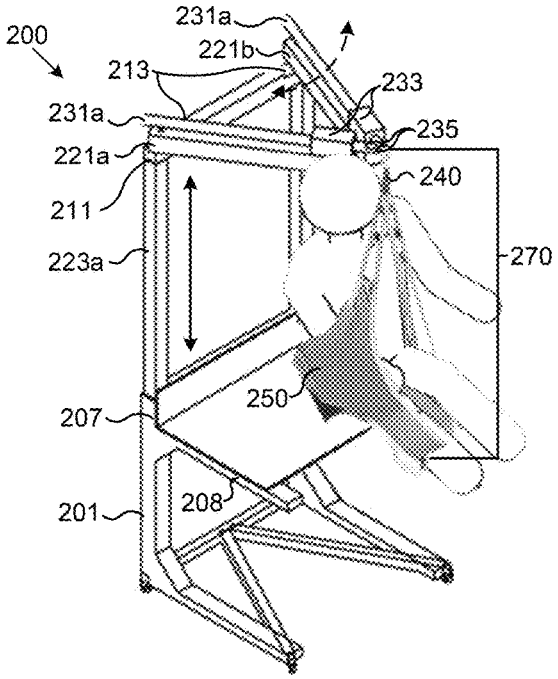
Figure 2C:
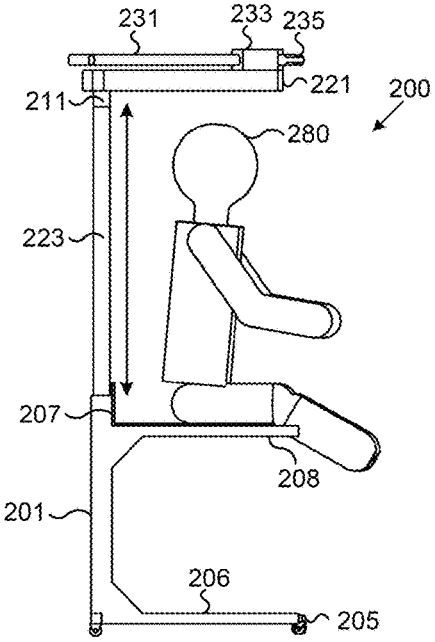

An extendable beam 111 may be fixed to the support frame 101 or removably attached to the support frame 101. As shown in FIG. 2A-2C, the extendable beam 111 may slide, retract, or otherwise move vertically away from the support frame 101 using masts 223*a*, 223*b*. The extendable beam 111 may be configured, for example, such that the top, bottom, and side surfaces align with the outer surfaces of the support frame 101. The extendable beam 111 may slide, retract, or otherwise move in a direction substantially perpendicular to seat extensions 108. Moreover, the extendable beam 111 may be securely fixed to the support frame 101 at a predetermined distance away from seat extensions 108 using one or more screws, bolts, levers, handles, knobs, or other easily turnable fittings (not shown) on support frame 101. Thus, extendable beam 111 may be extended away from support frame 101 and fixed at a predetermined height to provide, for example, better back support for the patient.

To provide for a compact design and easy assembly, the extendable beam 111 may be a detachable component of transport device 100. Moreover, the extendable beam 111 may be detachable to allow for repairs or replacement with one or more improved components. The extendable beam 111 may comprise of one or more slidable or retractable structures that extend out from support frame 101 or extend telescopically away from seat extensions 108. The extendable beam 111 may comprise of one or more bendable, foldable, or rotatable pieces or sections attached together at one or more hinges, connectors, or pivot points (not shown) to extend, rotate, or fold out to a predetermined height from the seat extensions 108.

The seat extensions 108 may be made of fabric, leather, plastic web, willow, bamboo or other material. The frame and components of the frame 101 may be made of aircraft aluminum (6061-T6) which makes it extremely strong yet lightweight.

Similar to the exemplary extendable beam 111, anti-tip bars 105 may extend away from legs 106 and brace 102 to provide better leverage and stability for safely transporting patient 180 from transport device 100. The anti-tip bars 105 may slide, retract, or otherwise move laterally away from the support frame 101. The exemplary transport device 100 may include locking mechanism, for example, locks 164*a*, 164*b* for securing anti-tip bars 105 at a fully extended position (e.g. FIGS. 3A-3D), partially extended position, or fully retracted position (e.g. FIGS. 1A-1D) within anti-tip support frame 104.

The transport device 100 may include a plurality of wheels 103. A wheel 103 may be positioned at each end of the legs 106, and at least one wheel 103 may be positioned at an end of each anti-tip bar 105. Further, each wheel 103 may include a wheel lock 160*a*, 160*b* configured to lock the transport device 100 and anti-tip bars 105 in place while a caregiver transports patient 180. A wheel lock 160*a*, 160*b* may be positioned at an end of each leg 106 and at an end of each anti-tip bar 105.

Figure 1B:
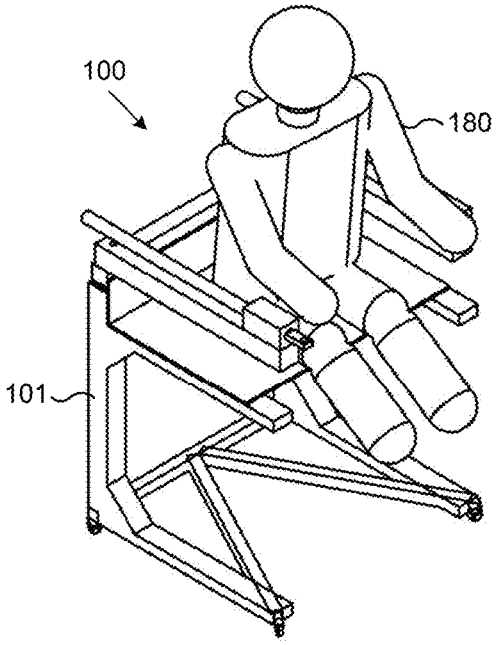
Figure 1C:
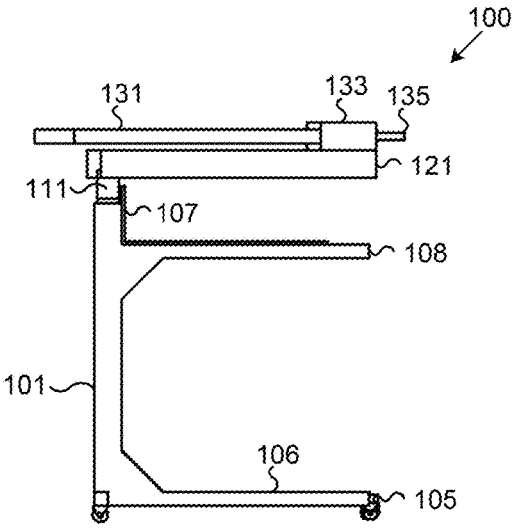
Figure 1D:
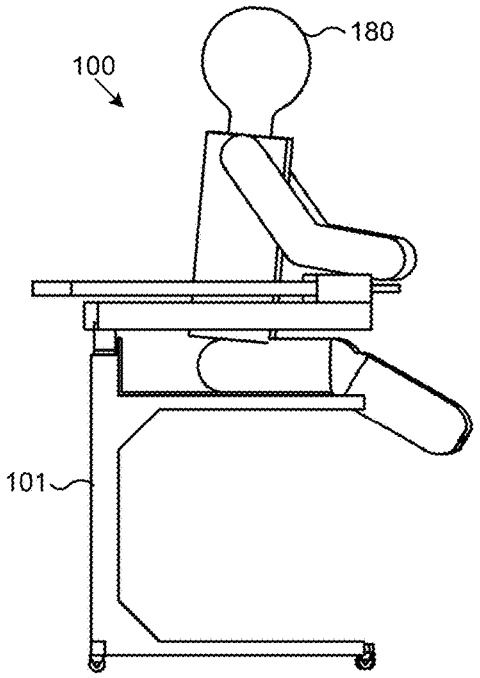

Referring to FIGS. 1A-1C and FIGS. 2A-2B, the upper portion of the exemplary transport device 100 may include booms 121*a*, 121*b*, boom hinge points 121*c*, 121*d*, clearance 113, masts 223*a*, 223*b*, boom arms 131*a*, 131*b* (hereafter "boom arms 131"), cradle hinge points 133*a*, 133*b* (hereafter "hinge points 133"), and cradle assembly 270 attachment points 135*a*, 135*b* (hereafter "attachment point 135"). The booms 121*a*, 121*b* may be moveably fixed to the beam 113 using boom hinge points 121*c*, 121*d*. As shown in FIG. 1B and FIG. 1D, the upper portion of the exemplary transport device 100 provides a pair of arm rests for the patient 180 through booms 121*a*, 121*b*, boom arms 131*a*, 131*b* and cradle hinge points 133*a*, 133*b*. Also, the upper portion of the exemplary transport device 100 may provide upper back support for patient 180 through adjustments in the heights of masts 223*a* and 223*b*. The masts 223*a* and 223*b* may be adjusted to accommodate larger sheets 107, a detachable seat back, head rest, and cushioning to enable an upright and comfortable seating position for patient 180. Moreover, the masts 223*a*, 223*b* may slide, retract, or otherwise move vertically away from the support frame 101 and securely fixed at a predetermined height using one or more screws, bolts, levers, handles, knobs, or other easily turnable fittings (not shown) on support frame 101.

FIGS. 2A-2D illustrate an upper portion of the exemplary transport device 200 in accordance with one or more exemplary embodiments of the present disclosure. As shown in FIG. 2A, beam 211 and booms 221*a*, 221*b* are raised to a predetermined height above the head of the patient 280 using masts 223*a*, 223*b* and may then be held in place mechanically, electrically, hydraulic, pneumatically, or any combination thereof. For example, using one or more screws, bolts, levers, handles, knobs, other easily turnable fittings (not shown), motors, gears, battery, springs, hydraulic or pneumatic lifts, shocks, and the like on support frame 201. The beam 211 includes clearance 213 for booms 221*a*, 221*b* to rotate inwards to form a leverage point, or fulcrum, for the pulley at attachment point 235 as shown in FIG. 2B.

Figure 2D:
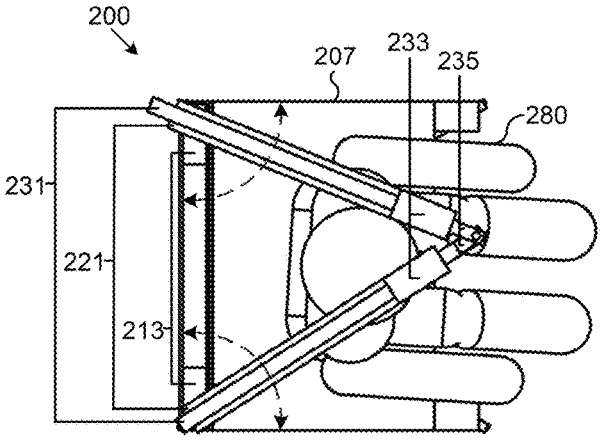

In some aspects, clearance 213 may not be formed on beam 211 and booms 221*a*, 221*b* may be mounted and rotatably fixed to beam 211 to improve stability of booms 221*a*, 221*b* by restricting motion and improving the durability of beam 211. Alternatively, clearance 213 may be formed at the left and right sides of booms 221*a*, 221*b* to restrict the booms 221*a*, 221*b* from rotating freely during patient transport and to reduce shaking or swaying of booms 221*a*, 221*b* with patient 280 as a load at attachment points 235. Each of the attachment points 235 may be formed on each of the boom arms 231. As shown in FIG. 2D, booms 221*a*, 221*b* may freely rotate between clearance 213 so the patient 280 may be extended telescopically away from frame 201 to be safely and comfortably transported to another location or positioned on a bed, vehicle, seat, or chair.

The boom arms 231 may slide outwards from frame 201 while being secured by hinge points 233. In some exemplary embodiments, the hinge points 233 may be formed over booms 221*a*, 221*b* and completely cover booms 221*a*, 221*b*. The boom arms 231 may then retract or slide out of hinge points 233 using attachment points 235. Once the boom arms 231 are coupled to one another through the attachment points 235, the cradle assembly 270 may be attached to the attachment points 235. The cradle assembly 270 comprises of a pulley strap 240 and a harness 250. The pulley strap 240 may be any one of a belt, strap, chain, or cable suitable for holding a patient 280. The harness 250 may be any of a pad, a sling, a blanket, or any fabric for cradling or holding a patient 280. In some exemplary embodiments, the sheet 207 may serve as a harness 250. The pulley strap 240 may couple to a plurality of grommets positioned along the edges on sheet 207. In some exemplary embodiments, harness 250 may be a sling or pad having a plurality or straps, bands, cables, or chains, for attaching directly to attachment points 235. Alternatively, as shown in FIG. 3D, the harness 350 may couple to a hanger, hoist, or hook attached to the attachment points 335. Referring to FIG. 2B, the boom arms 231*a*, 231*b* may be extended slightly away from hinge points 233 to allow the harness 250 and pulley strap 240 to easily secured and attached to the attachment points 235 by a caregiver.

The cradle assembly 270, pulley straps 240, and harness 250 may be positioned, connected to, secured, or attached anywhere along the torso of patient 280. For example, the cradle assembly 270 may comprise of a harness 250 and pulley straps 240 that, in part or in whole, wrap around or attach to the torso of the patient 280 similar to a back brace, girdle, sling, and the like.

Figure 3A:
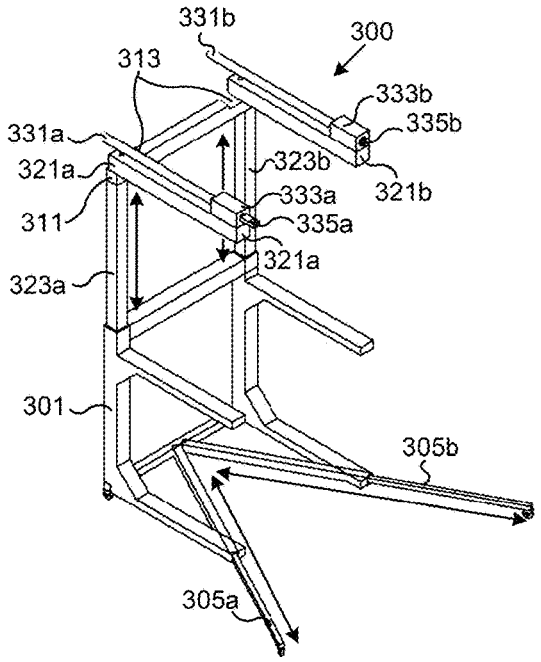
FIGS. 3A-3D illustrate perspective views of an exemplary embodiment of the patient transport device of FIGS. 1A-ID with moveable booms further extended and anti-tip bars extended to support a patient transport in accordance with one or more exemplary embodiments of the present disclosure.
Figure 3B:
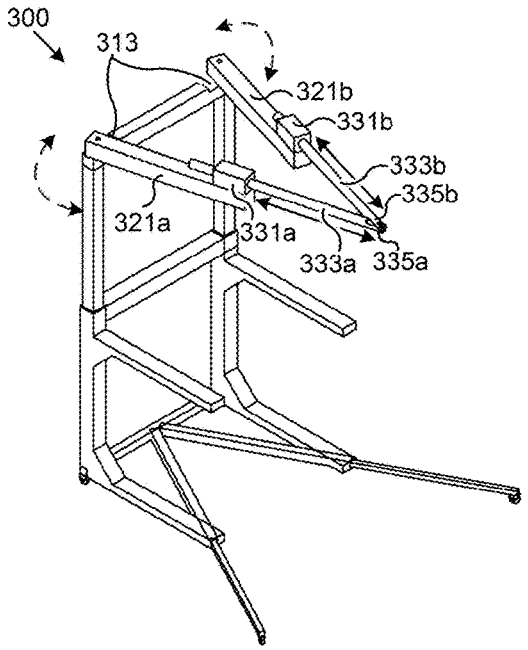
Figure 3C:
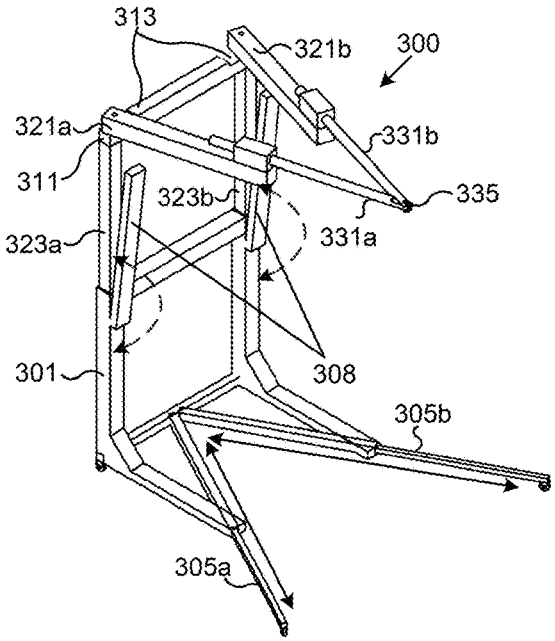
Figure 3D:
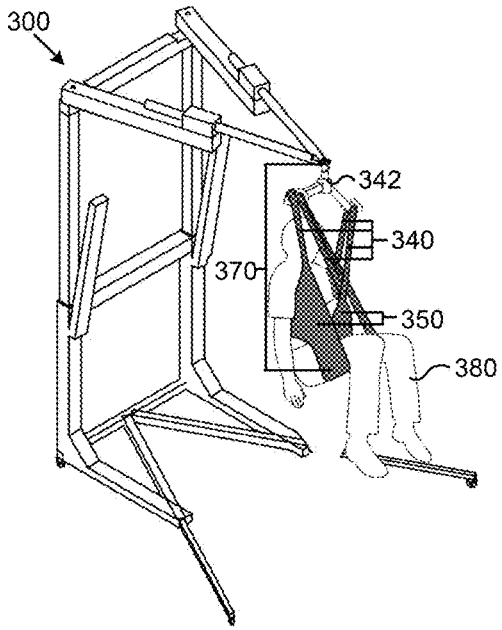

FIGS. 3A-3D illustrate usage of the lower and upper portions of the exemplary transport device 300 in accordance with one or more exemplary embodiments of the present disclosure. As shown in FIGS. 3A-3B, once a location for unloading patient 380 has been determined, anti-tip bars 305*a*, 305*b* may be extended to provide better leverage for transporting patient 380 to another location or positioned on a bed, vehicle, seat, or chair. The booms 321*a*, 321*b* may be rotated inwards, attachment points 335*a*, 335*b* may be coupled together to form the fulcrum of the pulley at attachment points 335*a*, 335*b*, and the boom arms 331*a*, 331*b* may be extended away from frame 301 to facilitate connection of the cradle assembly 370 to the attachment points 335*a*, 335*b*. Referring to FIGS. 3B-3D, the patient 380 may be extended further away from hinge points 333 using boom arms 331*a*, 331*b*. The harness 350 and pulley strap 340 being secured to attachment points 335. The boom arms 331*a*, 331*b* may be extended further to place patient 380 directly on a seat, in a vehicle, or on a bed. Thus, allowing a caregiver to raise a patient 380 to the desired height using masts 323*a*, 323*b* then horizontally extend patient 380 at, or just above, the desired seating position on a bed or in a vehicle. Moreover, the seat extensions 308 may be folded back as shown in FIGS. 3C-3D, for example, to improve the freedom of motion of patient 380, to allow the caregiver to position transport device 300 and patient 380 closer to a vehicle seat or bed without over extending boom arms 331*a*, 331*b*, or to allow a caregiver to move or roll into place, a chair, wheelchair, or other vehicle or seat directly beneath the patient 380. The cradle assembly 370 may include one or more brackets 342, one or more pulley straps 340, and one or more harnesses 350 together coupled to attachment points 335. The bracket 342 may hold pulley straps 340 at a predetermined distance away from patient 380 spreading out harness 350 to reduce strain and compression on patient 380. The bracket 342 may include a ball and joint connection to rotate or pivot to allow easier transport of patient 380.

The components of the upper and lower portions of the transport device 300, for example, support frame 301, support brace 102, at least two wheels 103, anti-tip bars 305*a*, 305*b*, booms 321*a*, 321*b*, masts 323*a*, 323*b*, boom arms 331*a*, 331*b*, attachment points 335*a*, 335*b*, cradle assembly 370, hinge points 333, harness 350, pulley strap 340, brackets 342, and attachment points 335 may be made of an elastomeric material selected from the group consisting of rubber, plastics or similar rubber, neoprene, silicone, and polyurethane. Other suitable materials for the components of the upper and lower portions of the transport device 300 may further comprise of a low friction material selected from the group consisting of plastics, molded or extruded medical grade, plastic, materials plastic reinforced with fiber, metal, rolled steel, stainless steel, aluminum, aluminum, impact resistant plastics material reinforced by carbon reinforced fiber material such as steel or metal rolled, stainless steel, aluminum or preferably titanium. For an even lower friction, the surfaces may be smooth, glazed, polished or polished. Still, other suitable materials for the components of the upper and lower portions of the transport device 300 may contain or be made of, in part or in whole, square or rectangular tubing formed from a suitable material such as, for example, steel, aluminum, titanium, plastic, or composite providing the desired combination of stiffness, light weight, and ruggedness.

Figure 4A:
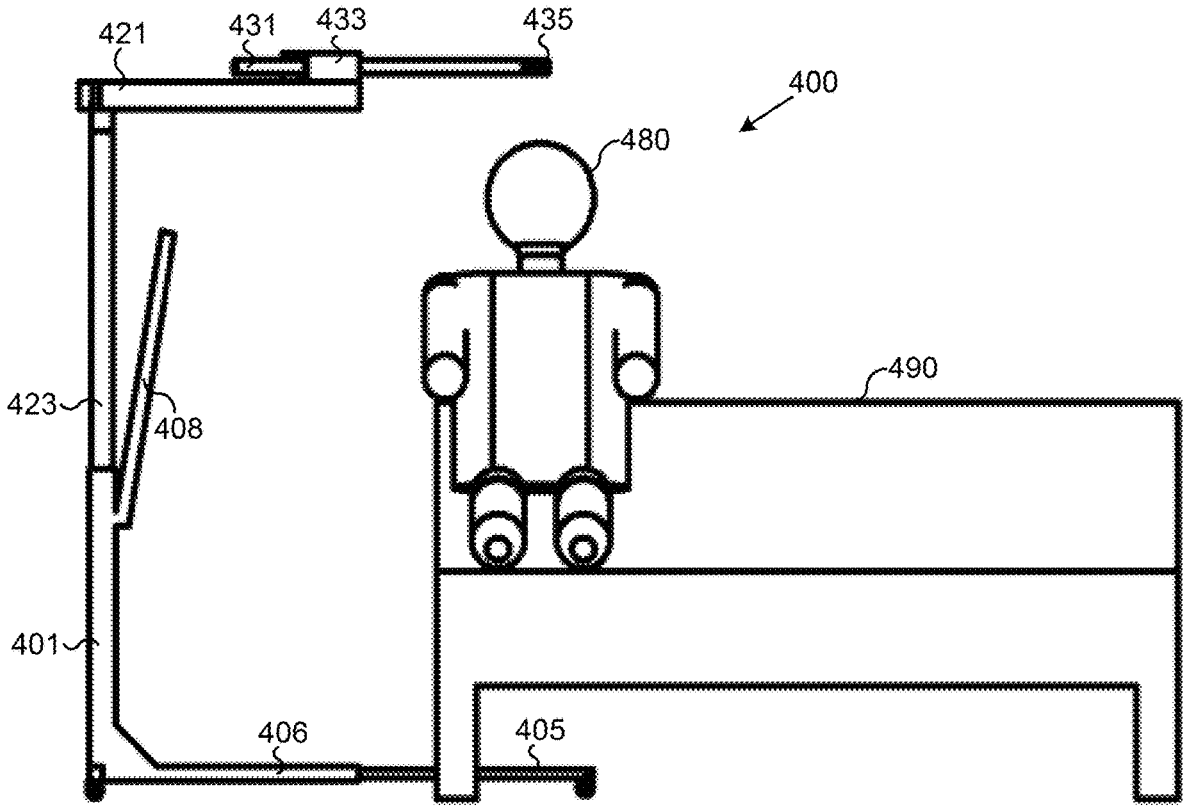
FIGS. 4A-4B illustrate plan and side views of an exemplary embodiment of the patient transport device of FIGS. 1A-1D with moveable booms, masts, and anti-tip bars positioned to support a patient transport onto a seat or bed in accordance with one or more exemplary embodiments of the present disclosure.
Figure 4B:
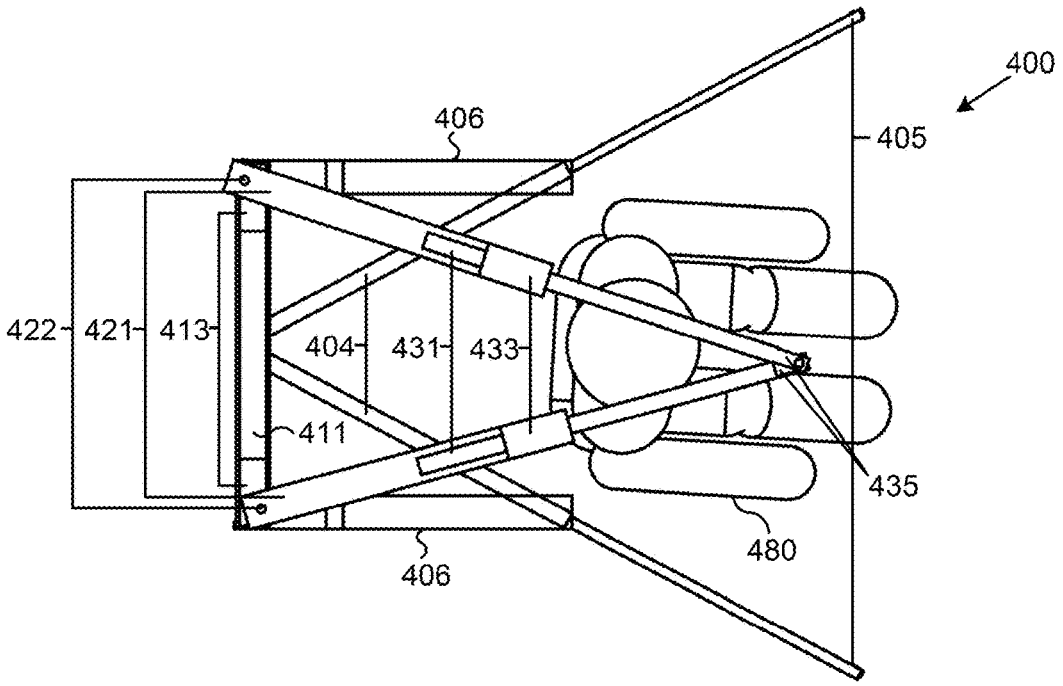

FIGS. 4A-4B illustrate one exemplary embodiment of incorporating the exemplary transport device 400 in an existing wheelchair chassis in accordance with one or more exemplary embodiments of the present disclosure. The transport device 400 may be positioned near bed 490 anti-tip bars 405 may be extended outwards anytime during the transport of patient 480. Masts 423 may be raised to a predetermined height suitable to laterally moving the patient 480 to be positioned directly above bed 490. Boom arms 431 may be extended out in front of and above patient 480 at a first position for securing the patient 480 to a cradle assembly 370. The patient 480 may be secured to attachment points 435 using cradle assembly 370, seat extensions 408 may be folded back, then boom arms 431 may be further extended, as needed, to a second position placing patient 480 directly above bed 490.

FIGS. 1A-4B illustrate exemplary embodiments of the transport device 400. The transport device 400 may be incorporated into the chassis or frame of any existing wheelchair chassis in accordance with one or more exemplary embodiments of the present disclosure. As shown in FIGS. 1A-1D, the transport device frame 101 may be, in part or in whole, a wheelchair chassis having anti-tip support frames 104 and anti-tip bars 105 built into the base of a wheelchair chassis. The seat extensions 208 may provide a seating support for patient 280, the masts 223 may be extended to form at least part of the back support for the patient 280 as shown in FIGS. 2A-2C. The upper portion of the exemplary transport device 300 may be folded, collapsed, or retracted into the frame 301 to provide arm rest of a wheelchair chassis as shown in FIGS. 3A-3D. Moreover, when incorporated in a wheelchair chassis, anti-tip support frame 104 and support brace 102 may further improve the structural rigidity of the frame 101 to better support the extendable beam 111 and retractable anti-tip bars 105.

Figure 5A:
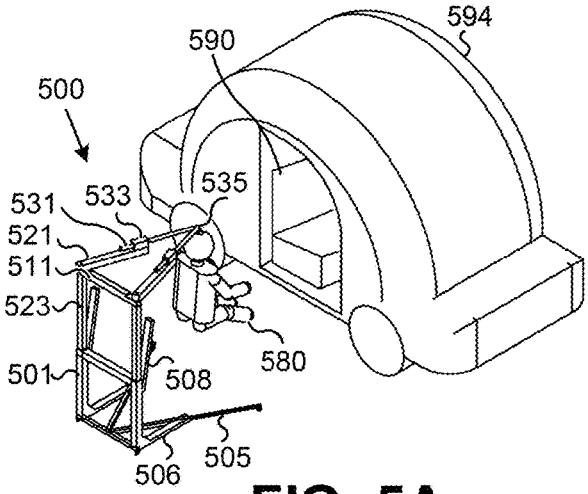
FIGS. 5A-5F illustrate plan and side views of an exemplary embodiment of the patient transport device of FIGS. 1A-1D with moveable booms, masts, and anti-tip bars positioned to support a patient transport onto a seat of a vehicle in accordance with one or more exemplary embodiments of the present disclosure.
Figure 5B:
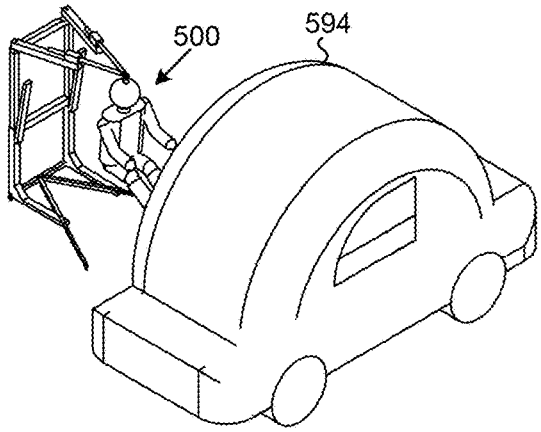
Figure 5C:
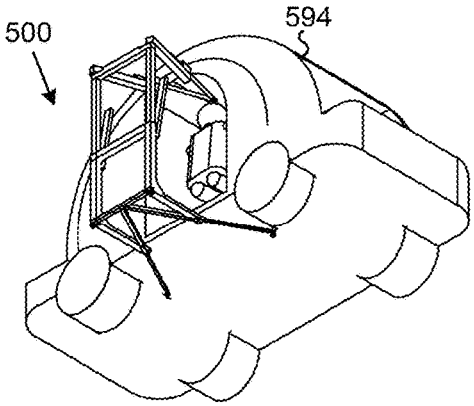
Figure 5D:
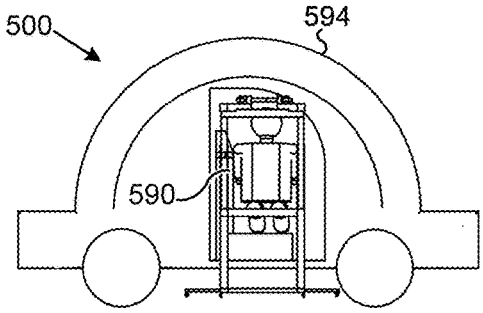
Figure 5E:
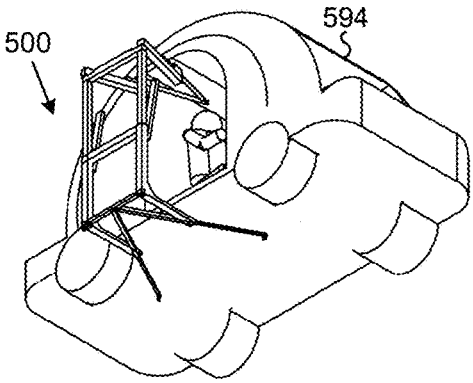
Figure 5F:
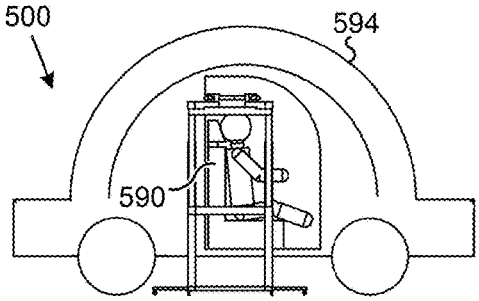

FIGS. 5A-5F illustrate an exemplary embodiment of using the transport device 500 to transport patient 580 onto a seat 590 of a vehicle 594. The transport device 500 comprises of anti-tip bars 505 that may be extended outwards anytime during the transport of patient 580. The transport device 500 may include masts 523 for raising patient 580 to a predetermined height above seat 590 suitable for laterally moving patient 580 to be positioned just above seat 590. Masts 523 and boom arms 531 may be extended out from frame 501 to position patient 580 within vehicle 594. As shown in FIGS. 5A-5B, the boom arms 531 may be extended in front of and above patient 580 at a first position for securing the patient 580 to a cradle assembly 370. The patient 580 and cradle assembly may be secured to attachment points 535 of the transport device 500. The seat extensions 508 may be folded back, then boom arms 531 may be further extended, as needed, to a second position placing patient 580 directly above seat 590. As shown in FIGS. 5C-5F, the transport device 500 may be wheeled into the second position with legs 506 positioned closer to seat 590. The anti-tip bars 505 may be extended to stabilize the transport device 500 and allow patient 580 to be positioned inside the vehicle 594. The patient 580 may be rotated while inside the vehicle 594 using the cradle assembly 370 and attachment points 535. The patient 580 may be lowered onto seat 590 by lowering masts 523 to a predetermined height or by reducing the tautness or tension in the cradle assembly 370, the one or more pulley straps 340, the one or more harnesses 350, or by reducing the tension or height of the one or more brackets 342.

Figure 6A:
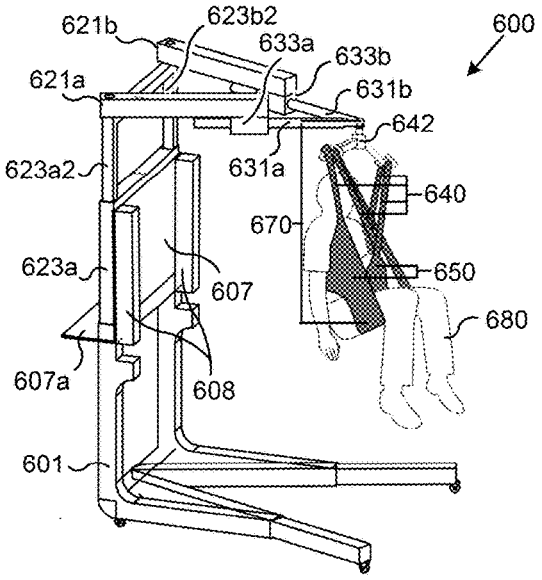
FIGS. 6A-6D illustrate plan and side views of an exemplary embodiment of the patient transport device of FIGS. 1A-ID with extendable mast segments and a driver for automation of a patient transport onto a seat, bed, or onto a vehicle seat in accordance with one or more exemplary embodiments of the present disclosure.
Figure 6B:
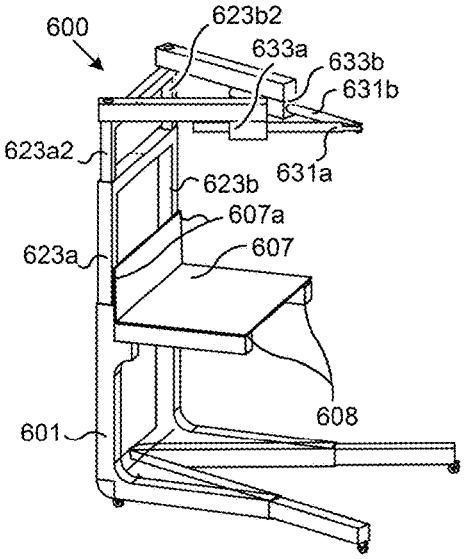

FIGS. 6A-6D illustrate another exemplary embodiment of the upper and lower portions of the transport device 600. As shown in FIGS. 6A-6B, masts 623*a*, 623*b* Truly include one or more extensions or retractable segments 623*a*2, 623*b*2 for raising patient 680 to a predetermined height. Moreover, to provide easier access for a caregiver to extend the patient 680 outwards towards a seat or bed, boom arms 631*a*, 631*b* may be positioned on the side or below booms 621*a*, 621*b*. Similarly, hinge points 633*a*, 633*b* may be positioned on the side or below booms 621*a*, 621*b* to provide easier access for a caregiver to extend patient outwards using the boom arms 631*a*, 631*b* and/or rotate the patient using booms 621*a*, 621*b*.

The seat extensions 608 and sheet 607 may comprise of one or more handles 607*a* positioned near the top edges of the sheet 607 such that when the sheet 607 is folded back the handles 607*a* may be used to position the transport device 600 closer to a vehicle, seat, or bed.

The patient 680 may be lowered by lowering masts 523*a*, 523*b* or segments 623*a*2, 623*b*2 to a predetermined height or by reducing the tautness or tension in the cradle assembly 670, the one or more pulley straps 640, the one or more harnesses 650, or by reducing the tension or height of the one or more brackets 642.

Figure 6C:
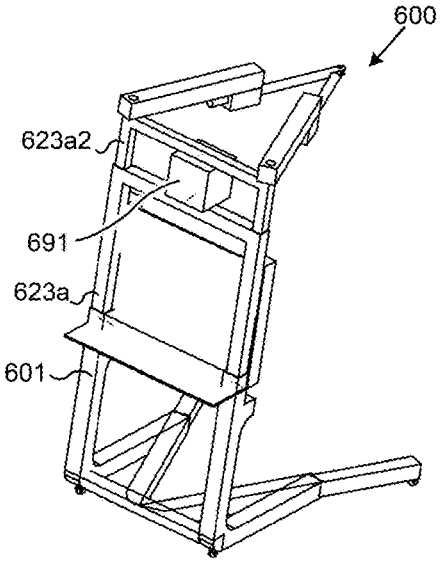
Figure 6D:
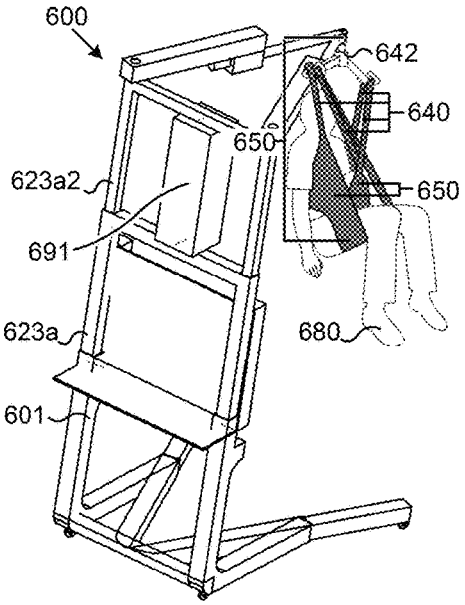

Referring to FIGS. 6C-6D, the transport device 600 may include a driver 691 that may include a mechanical, electrical, hydraulic, or pneumatic device, or any combination thereof for moving and holding in place any part or component of transport device 600. For example, the driver 691 may be used for raising or lowering masts 623*a*, 623*b* and segments 623*a*2, 623*b*2, rotating or moving booms 621*a*, 621*b*, sliding, retracting, or extending boom arms 631*a*, 631*b* and anti-tip bars 605*a*, 605*b*, and folding or retracting sheet 607 and handles 607*a*. Once a location for unloading patient 680 has been determined, anti-tip bars 605*a*, 605*b* may be extended to provide better leverage for transporting patient 680 to another location or positioned on a bed, vehicle, seat, or chair.

The driver 591 may include levers, handles, knobs, other easily turnable or pressable fittings (not shown), motors, gears, battery, springs, hydraulic or pneumatic lifts, shocks, and the like positioned on support frame 601.

In some exemplary embodiments, upper portion, lower portion, or both of the exemplary transport device 400 may be manually extended outwards to improve leverage and stability of a wheelchair for safely transporting patient 480 from transport device 400. In some exemplary embodiments, the upper portion or lower portion may include an automated or semi-automated lifting mechanism, for example, a scissors jack, a pneumatic or hydraulic jack or any number of alternative devices used to give a caregiver mechanical advantage in transporting patient 480. The lifting mechanism may be configured for raising patient 480 to first predetermined height, extending patient 480 outwards to first predetermined length, then positioning patient 480 onto bed 490.

The term "within a proximity", "a vicinity", "within a vicinity", "within a predetermined distance", "predetermined width", "predetermined height", "predetermined length" and the like may be defined between about 0.1 meters and about 3 meters. The term "coupled" is defined as connected, whether directly or indirectly through intervening components, and is not necessarily limited to physical connections. The connection may be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but may have one or more deviations from a true cylinder. The term "comprising," when utilized, means "including, but not necessarily limited to"; it specifically indicates open-ended inclusion or membership in the so-described combination, group, series and the like.

The term "a predefined" or "a predetermined" when referring to length, width, height, or distances may be defined as between about 0.1 meter and about 3 meters.

The booms (e.g. booms 321) and seat extensions (e.g. seat extensions 308) may be defined by a percentage of openness of between about 1-99%. For example, partially opening the booms 321 to about 99% means the booms 321 are about completely open or folded out and substantially perpendicular to the beam 311, and partially opening the booms 321 to about 1% means the booms 321 are about completely closed or folded in and substantially parallel to the beam 311. Similarly, partially opening the seat extensions 308 to about 99% means the seat extensions 308 are about completely open or folded out and substantially perpendicular to the frame 301, and partially opening the seat extensions 308 to about 1% means the seat extensions 308 are about completely closed or folded in and substantially parallel to the frame 301.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the present disclosure, the disclosure, the present disclosure, other variations thereof and alike are for convenience and do not imply that a disclosure relating to such phrase(s) is essential to the present disclosure or that such disclosure applies to all configurations of the present disclosure. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The word "exemplary" is used herein to mean "serving as an example, instance, or illustration." Any embodiment described herein as "exemplary" or as an "example" is not necessarily to be construed as preferred or advantageous over other embodiments. Furthermore, to the extent that the term "include", "have", or the like is used in the description or the claims, such term is intended to be inclusive in a manner similar to the term "comprise" as "comprise" is interpreted when employed as a transitional word in a claim.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for."

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

The embodiments shown and described above are only examples. Many details are often found in the art such as the other features of an image device. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed:

1. A wheelchair, comprising:

a support frame having an upper portion located at a first end of the support frame and a lower portion located at a second end of the support frame;

at least one seat extension movably coupled to the support frame and positioned between the lower portion and upper portion of the support frame;

at least one leg coupled to the lower portion of the support frame, the at least one leg extending from the second end of the support frame;

at least one retractable anti-tip bar disposed on the lower portion of the support frame;

an extendable beam positioned behind the seat extension and movably coupled to the support frame to extend vertically with respect to the support frame;

one or more retractable masts coupling the extendable beam to the support frame that extends outwards to position the extendable beam at a predetermined position above the patient and retracts inwards to position the extendable beam behind the seat extension;

two booms, each of the two booms rotatably coupled to the extendable beam at each of the opposite ends of the extendable beam, a distal end of each boom rotates inwards towards the corresponding other opposite end of the extendable beam and each boom comprising a movable boom arm that extends and retracts from the boom; and an upper surface of at least one of the two booms provides an arm rest for the patient when the one or more retractable masts is retracted towards the seat extension, and when the one or more retractable masts are extended away from the seat extension there are no arm rests for the patient.

2. The wheelchair of claim 1, wherein each movable boom arm is configured to extend outwards to be positioned in front of the seat extension.

3. The wheelchair of claim 1, wherein the at least one seat extension folds back, collapses, or retracts towards the support frame.

4. The wheelchair of claim 1, wherein an upper surface of at least one of the movable arms provides an arm rest for the patient when the one or more retractable masts is retracted towards the seat extension.

5. The wheelchair of claim 1, wherein each boom further comprises a hinge point positioned on the boom and housing at least a portion of the movable boom arm, and an attachment point located at an opposite end of each boom arm.

6. The wheelchair of claim 5, wherein a cradle assembly attaches to the attachment point, the cradle assembly comprising a pulley strap and a harness.

7. The wheelchair of claim 6, wherein the cradle assembly further comprises a bracket.

8. The wheelchair of claim 1, wherein the support frame includes an automated or semi-automated lifting mechanism, wherein the lifting mechanism may be a scissors jack, a pneumatic jack, a hydraulic jack, a hydraulic lift, or a battery-operated motor.

9. The wheelchair of claim 1, wherein the predetermined position is anywhere along the torso of the patient.

10. The wheelchair of claim 1, wherein the predetermined position is approximately 0.2 meters above the head of the patient.

11. The wheelchair of claim 1, wherein the support frame further comprises of a support brace positioned at the lower portion of the support frame between the seat extension.

12. The wheelchair of claim 1, wherein the support frame further comprises at least one anti-tip support frame coupled to the lower portion of the support frame, wherein each retractable anti-tip bar directly attaches to and is completely enclosed by each anti-support frame.

13. The wheelchair of claim 1, wherein the extendable beam is vertically displaced from the seat extension when extended using the one or more retractable masts.

14. The wheelchair of claim 1, wherein the two booms are vertically displaced from the seat extension when the extendable beam is extended using the one or more retractable masts.

15. The wheelchair of claim 1, further comprising at least two wheels mounted to the lower portion of the support frame.

16. A device for patient transport, comprising:

a support frame, the support frame having an upper portion located at a first end of the support frame and a lower portion located at a second end of the support frame;

at least one seat extension movably coupled to the support frame and positioned between the lower portion and upper portion of the support frame;

at least one leg coupled to the lower portion of the support frame, the at least one leg extending from the second end of the support frame;

at least one retractable anti-tip bar disposed on the lower portion of the support frame;

an extendable beam positioned behind the seat extension and movably coupled to the support frame to extend vertically with respect to the support frame;

one or more retractable masts coupling the extendable beam to the support frame that extends outwards to position the extendable beam at a predetermined position above the patient and retracts inwards to position the extendable beam behind the seat extension;

two booms, each of the two booms rotatably coupled to the extendable beam at each of the opposite ends of the extendable beam, a distal end of each boom rotates inwards towards the corresponding other opposite end of the extendable beam and each boom comprises a movable boom arm that extends and retracts from the boom; and an upper surface of at least one of the two booms provides an arm rest for the patient when the one or more retractable masts is retracted towards the seat extension, and when the one or more retractable masts are extended away from the seat extension there are no arm rests for the patient.

17. The device of claim 16, wherein the support frame is incorporated into the chassis or frame of a wheelchair.

18. The device of claim 16, wherein each movable boom arm is configured to extend outwards to be positioned in front of the seat extension.

19. The device of claim 16, wherein each boom further comprises a hinge point positioned on the boom and housing at least a portion of the movable boom arm, and an attachment point located at an opposite end of each boom arm.

20. The device of claim 19, wherein a cradle assembly attaches to the attachment point, the cradle assembly comprising a pulley strap and a harness.

21. The device of claim 16, wherein the support frame includes an automated or semi-automated lifting mechanism, wherein the lifting mechanism may be a scissors jack, a pneumatic jack, a hydraulic jack, a hydraulic lift, or a battery-operated motor.

22. The device of claim 16, wherein the support frame further comprises a support brace positioned at the lower portion of the support frame between the seat extension and the at least one leg.

23. The device of claim 16, wherein the support frame further comprises at least one anti-tip support frame coupled to the lower portion of the support frame, wherein each retractable anti-tip bar directly attaches to and is completely enclosed by each anti-support frame.

24. The device of claim 16, further comprising at least two wheels mounted to the lower portion of the support frame.

* * * * *